United States Patent [19]

Hinzmann et al.

[11] Patent Number: 4,681,124

[45] Date of Patent: Jul. 21, 1987

[54] APPARATUS FOR MANIPULATING PARTICLES OF TOBACCO OR FILTER MATERIAL

[75] Inventors: Alfred Hinzmann, Weams; Peter Preisner, Quinton; Erich Presser, Richmond, all of Va.

[73] Assignee: Hauni-Werke Körber & Co. KG, Hamburg, Fed. Rep. of Germany

[21] Appl. No.: 729,540

[22] Filed: May 2, 1985

[51] Int. Cl.[4] ..... A24C 5/39

[52] U.S. Cl. ..... 131/109.1

[58] Field of Search ..... 131/109.1, 109.3, 84.1, 131/84.2, 84.3

[56] References Cited

U.S. PATENT DOCUMENTS

| | | | |
|---|---|---|---|
| 3,996,943 | 12/1976 | Hinzmann | 131/109.1 |
| 3,996,944 | 12/1976 | Hinzmann | 131/109.1 |
| 4,011,966 | 3/1977 | Wahle et al. | 131/109.1 |
| 4,037,608 | 7/1977 | Wahle | 131/84.1 |
| 4,185,644 | 1/1980 | Heitmann et al. | 131/109.1 |
| 4,484,589 | 11/1984 | Steiniger et al. | 131/109.1 |

FOREIGN PATENT DOCUMENTS

| | | | |
|---|---|---|---|
| 68310 | 10/1940 | Czechoslovakia | 131/109.3 |

*Primary Examiner*—Vincent Millin

*Attorney, Agent, or Firm*—Peter K. Kontler

[57] ABSTRACT

The distributor of a cigarette maker has an upright duct with an inlet at the top and an outlet at the bottom. The inlet receives particles of tobacco from a magazine and the accumulated particles descend in the duct to be removed at the outlet by the carding of a rotary drum-shaped conveyor in a substantially horizontal direction. The front wall of the duct, as considered in the direction of removal of tobacco particles from the duct, and the lower portion of the rear wall of the duct are oscillated, out of phase, by a common drive which moves the front wall and the lower portion of the rear wall horizontally at right angles to the direction of advancement of removed particles and in the general plane of the respective wall. The inner side of the front wall has protuberances which oscillate with reference to stationary protuberances at the inner side of the upper portion of the rear wall to promote the distribution of particles across the duct.

37 Claims, 8 Drawing Figures

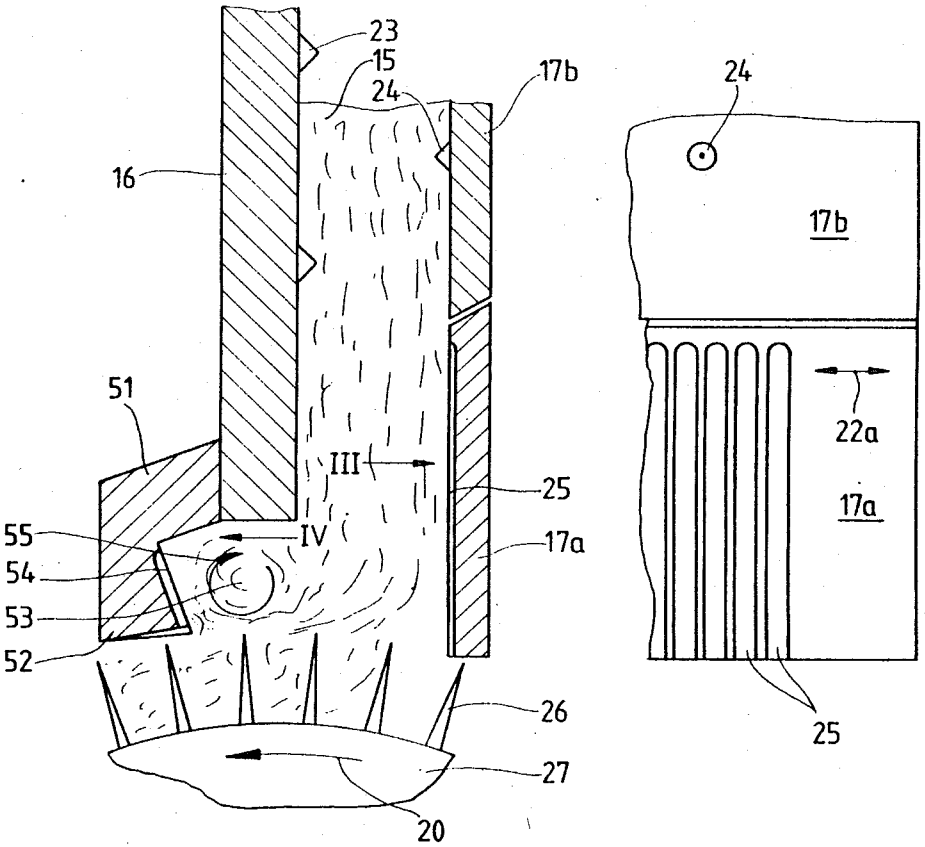
Fig. 3
Fig. 2
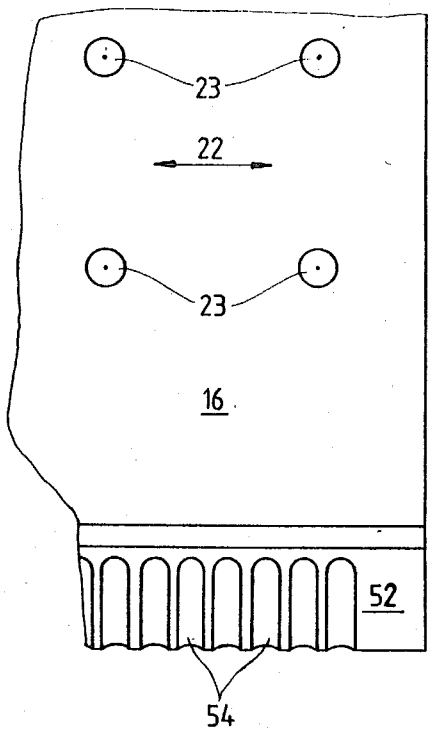
Fig. 4

APPARATUS FOR MANIPULATING PARTICLES OF TOBACCO OR FILTER MATERIAL

BACKGROUND OF THE INVENTION

The present invention relates to apparatus for manipulating discrete particles of fibrous material, such as shredded tobacco leaves or fibrous (textile) filter material (e.g., acetate fibers) which can be converted into fillers of filter rod sections for use in filter cigarettes and analogous rod-shaped articles of the tobacco processing industry. More particularly, the invention relates to improvements in apparatus for influencing particles of fibrous material during travel through a duct and during subsequent transport to a stream forming station, e.g., to a stream forming station in a cigarette maker wherein particles of tobacco and a wrapper of cigarette paper or the like are converted into plain cigarettes of unit length or multiple unit length.

It is already known to admit particles of tobacco leaves which are stored in the magazine of the distributor in a cigarette maker into an upright duct for controlled removal of particles from the duct and for further transport to the stream forming station of the cigarette maker. As a rule, the duct has two relatively large (wide) walls which flank the front and rear sides of the passage for gravitational descent of tobacco particles in the duct and two relatively narrow additional walls or end walls which alternate with the front and rear walls and define with the front and rear walls a passage having a substantially rectangular outline with two long sides and two much shorter sides. It is also known to impart oscillatory movements to at least one of the front and rear walls in order to promote the descent of tobacco particles toward the outlet of the passage in the duct. The duct is located between the aforementioned magazine and at a level above a carded drum which removes the particles at the outlet of the passage and transports the removed material into the range of a rapidly rotating picker roller for conversion into a layer containing randomly distributed heavier particles (such as fragments of tobacco ribs) and lighter particles (predominantly or exclusively fragments of tobacco leaf laminae).

Heretofore known ducts which are used for the above outlined purpose in the distributors of cigarette makers are not entirely satisfactory because they cannot ensure the delivery of particles into the range of the carding on the drum-shaped conveyor at a relatively constant rate such as is most conducive to the formation of a homogeneous layer of separated particulate material and to conversion of the layer into a homogeneous tobacco stream which is ready for wrapping into cigarette paper or the like. It is particularly important to ensure that the material is uniformly distributed in the lower portion of the duct, i.e., in the region where the particles are engaged and entrained by the carding of the aforementioned drum-shaped conveyor. If the carding of the conveyor is not uniformly filled with particles of removed tobacco, the picker roller cannot convert the removed particles into a homogeneous layer and this affects the quality of the tobacco stream which is thereupon trimmed and wrapped to constitute the filler of a continuous wrapped tobacco rod.

British Pat. No. 329,256 discloses an apparatus wherein the front and rear walls of the tobacco duct in the distributor of a cigarette maker are agitated up and down (i.e., in the direction of gravitational descent of confined particles and/or in directions toward and away from each other. Such agitation of the front and rear walls fails to ensure adequate filling of the lower portion of the duct above the removing conveyor.

U.S. Pat. No. 2,113,544 discloses a modification of the duct which is disclosed in the aforementioned British patent. The front and rear walls of the duct which is disclosed in the United States patent are caused to perform movements in a manner as disclosed in the British reference but the movements of one of these walls are superimposed upon the movements of the other wall. This proposal also failed to gain acceptance in the relevant industry because it cannot ensure adequate filling of the duct in the region of the outlet.

Published British patent application No. 2 111 370 discloses a relatively small strip-shaped member which is disposed at a level below and in the space between the lower end portions of the stationary front and rear walls of the duct. The strip-shaped member is reciprocated in the axial direction of the carded drum-shaped conveyor therebelow and is intended to uniformize the distribution of removed tobacco particles in the carding of the conveyor. Reference may also be had to commonly owned U.S. Pat. Nos. 3,996,943, 3,996,944 and 4,011,966. These proposals also failed to ensure a highly satisfactory filling of the lower portion of the duct. On the other hand, and in view of the ever increasing output of cigarette makers, the formation of a homogeneous tobacco stream for conversion into the fillers of plain cigarettes is even more desirable than before because very little time is left for homogenization once the particles reach the stream forming station.

OBJECTS AND SUMMARY OF THE INVENTION

An object of the invention is to provide a novel and improved apparatus which can be used to manipulate discrete particles of fibrous material in machines for the making of rod-shaped articles of the tobacco processing industry.

Another object of the invention is to provide the apparatus with a novel and improved duct which ensures predictable and highly satisfactory distribution of particulate material prior to withdrawal and further processing into a continuous stream.

A further object of the invention is to provide a duct which is constructed and whose parts are moved in such a way that the particulate material descends therein at a predictable rate as well as that the outlet of the passage which is defined by the duct is invariably filled with uniformly distributed particulate material.

An additional object of the invention is to provide an apparatus of the above outlined character which can be installed in existing cigarette makers, makers of filter rod sections and analogous machines as a superior substitute for conventional apparatus.

Another object of the invention is to provide the apparatus with novel and improved means for imparting movements to selected portions of the duct.

Still another object of the invention is to provide the apparatus with novel and improved means for promoting the descent and distribution of particles in the interior of the duct.

A further object of the invention is to provide a novel and improved duct for use in the above outlined apparatus.

An additional object of the invention is to provide the apparatus with novel and improved means for preventing prolonged dwell of particulate material at the outlet of the passage which is defined by the duct.

Another object of the invention is to provide a novel and improved method of manipulating fibrous material between the magazine and the stream forming station of a cigarette maker or the like.

The invention is embodied in an apparatus for manipulating fibrous material, particularly for manipulating particles of tobacco in the distributor of a cigarette maker. The apparatus comprises an at least substantially upright duct defining an elongated passage having an inlet at the upper end and an outlet at the lower end. The duct comprises first and second walls which are disposed opposite each other and flank the passage, and the apparatus further comprises means for supplying fibrous material into the inlet so that the material advances in the passage in a first direction toward the outlet, and drive means for imparting to at least a portion of at least one of the walls an oscillatory movement in a second direction at least substantially at right angles to the first direction and in the general plane of the respective wall to thus promote the distribution of fibrous material across the passage. The apparatus further comprises means (preferably a rotary drum-shaped conveyor whose peripheral surface is provided with a suitable carding) for continuously removing fibrous material from the outlet and for advancing the removed material in a third direction at least substantially at right angles to the first and/or second direction. The one wall is located downstream of the other wall, as considered in the (third) direction of advancement of the removed material. The third direction is preferably normal or substantially normal to the planes of the first and second walls.

The one wall is preferably provided with a plurality of material-engaging and agitating protuberances which extend into the passage and effect a desirable distribution of fibrous material in the second direction, namely in parallelism with the planes of the first and second walls. The protuberances can be arrayed in first rows which extend in the first direction and second rows which extend in the second direction. The mutual spacing of neighboring protuberances in the first rows preferably matches or approximates the mutual spacing of neighboring protuberances in the second rows.

In accordance with a presently preferred embodiment, the drive means includes means for oscillating at least a portion of each of the first and second walls. The arrangement is preferably such that the oscillatory movements of a portion of or the entire first or second wall are 180 degrees out of phase with the oscillatory movements of a portion of or the entire second or first wall. The drive means preferably oscillates the entire downstream wall (as considered in the third direction) and the lower portion of the upstream wall, i.e., that portion of the upstream wall which is adjacent to the outlet of the passage in the duct. This lower portion of the upstream wall can have a smooth side which faces the outlet or such side can be provided with elongated shallow grooves which preferably extend in the first direction.

That (upper) portion of the upstream wall which is disposed above the outlet of the passage is preferably provided with stationary protuberances which extend into the passage opposite the (oscillating) protuberances of the downstream wall. The stationary protuberances can be disposed in parallel horizontal rows at several levels, and the oscillating protuberances are also disposed in several parallel horizontal rows at different levels. At least some of the rows formed by the oscillating protuberances preferably alternate with (i.e., they are disposed at different levels than) some or all of the rows of the stationary protuberances. The protuberances at the inner side of the downstream wall are preferably oscillatable with reference to discrete stationary protuberances between first and second end positions (as considered in the second direction) at the opposite sides of the respective stationary protuberances. The drive means can comprise a single input element (e.g., a rotary cam) and first and second output elements (e.g., in the form of rods or bars having followers tracking the cam) each of which receives motion from the input element, one of which transmits oscillatory motion to the downstream wall and the other of which transmits such motion to the lower portion of the upstream wall.

The passage which is defined by the duct is or can be at least substantially vertical. The outline of the inlet of the passage is preferably rectangular with two longer sides which are defined by the first and second walls and two shorter sides which alternate with the longer sides and are defined by two additional walls whose width (as considered in the circumferential direction of the duct) is or can be a relatively small fraction of the width of the first and second walls.

The aforementioned conveyor in the form of a rotary drum with peripheral carding is preferably disposed at a level directly or closely below the outlet of the passage, and the apparatus preferably further comprises a housing which defines with the duct a material-receiving chamber communicating with the outlet and disposed downstream of the outlet, as considered in the (third) direction of advancement of fibrous material with the carding of the drum-shaped conveyor. The housing can be provided on or can form an integral part of the downstream wall, and such housing can include a barrier which is disposed downstream of the one wall at a level above and close to the carding of the conveyor so as to prevent fibrous material from riding on top of the carding while such carding advances below the barrier and beyond the chamber. The barrier can be provided with a smooth inner side which faces the chamber; alternatively, such side of the barrier can be provided with elongated shallow grooves which preferably extend in the first direction, i.e., vertically downwardly if the duct defines a vertical passage.

The means for expelling fibrous material from the carding of the drum-shaped conveyor preferably comprises a picker roller which is driven at a constant or substantially constant speed and serves to expel the fibrous material onto a second conveyor (e.g., onto the upper reach of a relatively wide belt conveyor) which accumulates the expelled material into a relatively wide layer advancing in a predetermined direction, e.g., in or close to the third direction. The second conveyor is preferably driven at a constant speed or nearly constant speed.

The fibrous material normally contains lighter and heavier particles (e.g., shreds of tobacco leaf laminae and fragments of ribs if the fibrous material constitutes comminuted tobacco leaves). The apparatus then preferably further comprises winnower means which receives successive increments of the aforementioned layer and propels the particles of such increments whereby the trajectories of heavier particles deviate from the trajectories of lighter particles. Such apparatus then further comprises means for gathering the propelled heavier particles, means for driving the winnower means at an at least substantially constant speed, third conveyor means for intercepting the propelled lighter particles, and means for converting the intercepted lighter particles into a continuous stream which is then trimmed (if necessary) and draped into a web of cigarette paper or other suitable wrapping material.

Instead of being provided with discrete substantially circular protuberances, the inner side of the downstream wall of the duct can be formed with a plurality of elongated grooves or flutes which extend in the first direction all the way from the inlet to the outlet of the passage and are separated from each other by elongated upright ribs which can be said to constitute protuberances extending into the passage. Analogously, the substantially circular protuberances on the stationary upper portion of the upstream wall can be replaced with elongated grooves or flutes which extend in the first direction all the way from the inlet of the passage to the upper edge face of the oscillatable lower portion of the upstream wall. The ribs between the flutes or grooves at the inner side of the stationary upper portion of the upstream wall can be said to constitute elongated protuberances which extend into the passage. The same holds true for the ribs between the flutes or grooves at the inner side of the oscillatable lower portion of the upstream wall. The grooves or flutes at the inner side of the oscillatable lower portion of the upstream wall can extend all the way from the stationary upper portion of the upstream wall to the lowermost part of the upstream wall, i.e., all the way to the lowermost portion of the outlet of the passage.

The grooves or flutes in the inner side of the downstream wall can be identical with the flutes or grooves at the inner side of the upper and/or lower portion of the upstream wall of the duct.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is an enlarged vertical sectional view of the lower portion of the duct and a fragmentary elevational view of the material removing conveyor below the outlet of the passage;

FIG. 3 shows a part of the upstream wall of the duct in a view as seen in the direction of arrow III in FIG. 2;

FIG. 4 shows a part of the downstream wall of the duct and the housing which is attached to the lower portion of the downstream wall in a view as seen in the direction of arrow IV in FIG. 2;

DESCRIPTION OF THE PREFERRED EMBODIMENTS

Figure 1:
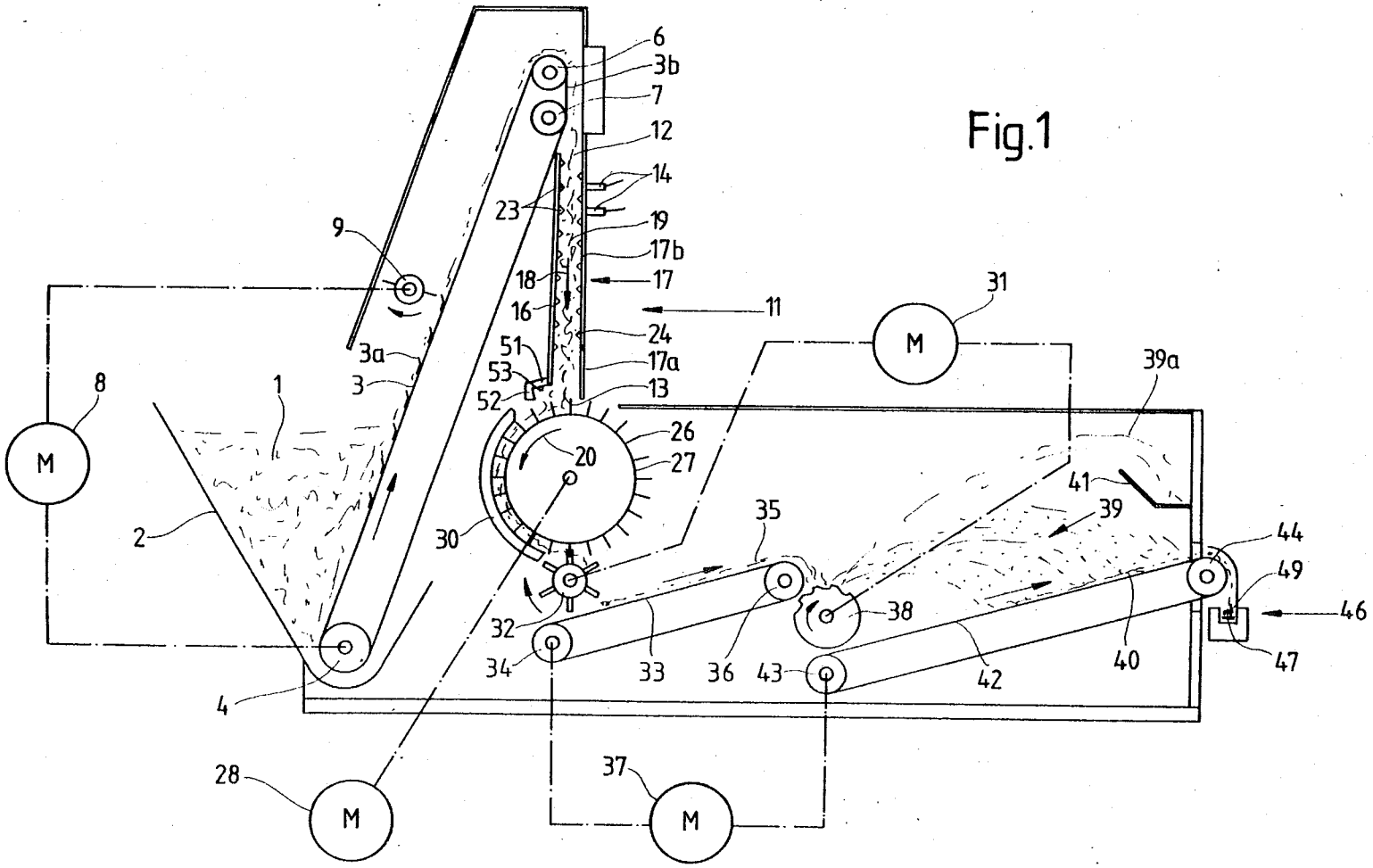
FIG. 1 is a schematic elevational view of an apparatus which is installed in the distributor of a cigarette maker and embodies one form of the invention, one of the narrower walls of the duct being omitted to expose the protuberances which extend into the passage.

Referring first to FIG. 1, there is shown a distributor which can be used in a cigarette maker, e.g., in a cigarette maker of the type known as PROTOS which is manufactured and sold by the assignee of the present application. The distributor includes an apparatus which embodies the present invention and is located downstream of a magazine 2 serving to accumulate and maintain a relatively large supply of fibrous material in the form of tobacco particles 1 including primarily shredded tobacco leaf laminae (lighter particles) and a certain percentage of heavier particles 39*a* such as fragments of tobacco ribs, birds' eyes and the like. The supply of tobacco particles 1 in the magazine 2 is replenished from time to time, e.g., by a pneumatic tobacco feeding conveyor of the type referred to in commonly owned U.S. Pat. No. 4,185,644.

The apparatus comprises an upright duct 11 which defines a preferably vertical upright channel or passage 19 with an inlet 12 at the upper end and an outlet 13 at the lower end. The means for supplying tobacco particles 1 into the inlet 12 comprises an endless belt conveyor 3 with pockets 3*a*. The upwardly moving reach of the conveyor 3 transports batches of tobacco particles past a refuser 9 in the form of a driven paddle wheel with leather straps or otherwise configurated vanes serving to remove the surplus from successive pockets 3*a* before the pockets dump their contents into the passage 19. The conveyor 3 is trained over pulleys 4, 6 and 7, and the pulley 4 is driven at a variable speed by an electric motor 8 which also drives the refuser 9. The stretch 3*b* of the conveyor 3 between the pulleys 6 and 7 is substantially vertical for reasons described in the aforementioned commonly owned U.S. Pat. No. 4,185,644.

The purpose of the improved apparatus is to ensure satisfactory distribution and homogenization of lighter tobacco particles on their way from the magazine 2 toward an elongated narrow tobacco channel 46 wherein the lighter particles are caused to form an elongated narrow tobacco stream 49 which is attracted by the upper reach of a narrow endless belt conveyor 47 for transport past one or more trimming devices and to the station where the thus obtained tobacco filler is draped into a web of cigarette paper or other suitable wrapping material in a manner not forming part of the present invention. Reference may be had, for example, to commonly owned U.S. Pat. No. 4,037,608 which describes and shows suitable means for trimming a continuous tobacco stream and for draping the resulting filler into a web of cigarette paper or the like. The draped web is thereupon converted into a tube by bonding its longitudinally extending marginal portions to each other, and the thus obtained continuous cigarette rod is subdivided into plain cigarettes of unit length or multiple unit length.

The upper portion of the duct 11 contains a battery of photocells 14 which monitor the upper level of the column of tobacco particles 1 in the passage 19 and generate signals which are processed to regulate the speed of the motor 8. This ensures that the height of the column of tobacco particles 1 in the duct 11 is at least substantially constant.

The duct 11 comprises two relatively large walls 16 and 17 whose planes are normal to the plane of FIG. 1 and two relatively small walls 15 (one shown in FIG. 2) which alternate with the walls 16 and 17. All of the walls are parallel with the (first) direction of downward movement of particles 1 in the passage 19 (such direction is indicated by the arrow 18), and the wall 16 is located downstream of the wall 17, as considered in the direction (arrow 20) of removal of tobacco particles from the outlet 13 of the passage 19. The direction which is indicated by the arrow 20 is substantially normal to the direction of arrow 18 as well as to the (parallel) planes of the walls 16 and 17. The width of the walls 16 and 17, as considered at right angles to the plane of FIG. 1, is substantial and is or can be many times the width of the walls 15. In other words, the outline of the inlet 12 of the passage 19 is a narrow rectangle with two longer sides which are defined by the walls 16, 17 and two shorter sides which alternate with the longer sides and are defined by the walls 15. The same preferably applies for the outline of the outlet 13 as well as for the outline of any intermediate portion of the passage 19.

In accordance with a feature of the invention, the apparatus further comprises a drive 21 (shown in FIG. 5) which serves to oscillate the entire downstream wall 16 and the lower portion 17*a* of the upstream wall 17 180° out of phase and in (second) directions (arrows 22 and 22*a* in FIGS. 3 to 5) at right angles to the plane of FIG. 1, i.e., in the general planes of the substantially or exactly flat walls 16 and 17. Thus, in contrast to prior proposals to impart to the upstream and downstream walls of the duct an oscillatory or analogous movement in the longitudinal direction of the passage and/or in directions at right angles to the planes of such walls, the drive 21 is designed to reciprocate the wall 16 and the lower portion 17*a* of the wall 17 at right angles to the direction which is indicated by the arrow 18 but not at right angles to the planes of the walls 16 and 17.

The upper portion 17*b* of the upstream wall 17 is stationary, and such upper portion carries certain components of the aforementioned photocells 14 as well as circular, oval or polygonal protuberances 24 which form several horizontal or nearly horizontal rows and extend into the adjacent portion of the passage 19. The stationary protuberances 24 are located opposite several rows of circular, oval or polygonal protuberances 23 which are provided at the inner side of the oscillatable wall 16 and also extend into the passage 19 to engage and agitate the particles 1 in the duct 11 and to thereby ensure that such particles are distributed across the passage 19, i.e., at right angles to the plane of FIG. 1. This promotes the downward movement of particles 1 as well as desirable homogenization of the column of such particles in the duct so as to allow for predictable removal of a continuous mass of particles from the outlet 13. The rows of protuberances 23 (see particularly FIG. 4) are disposed at different levels, and such levels preferably alternate with the levels of the horizontal rows of protuberances 24 (see FIG. 5) on the stationary upper portion 17*b* of the upstream wall 17. The extent of oscillatory movements of the downstream wall 16 is preferably such that each protuberance 23 is caused to move between two end positions at the opposite sides of the stationary protuberance 24 which is nearest thereto. The protuberances 23 preferably form an array of intersecting vertical and horizontal rows, and the mutual spacing of neighboring protuberances 23 in a horizontal row preferably matches or approximates the mutual spacing of neighboring protuberances in any of the vertical rows. This can be readily seen in FIG. 4.

The inner side of the oscillatory lower portion 17*a* of the upstream wall 17 is preferably smooth (as shown in the right-hand portion of FIG. 3) or is provided with relatively shallow elongated grooves or flutes 25 (shown in the left-hand portion of FIG. 3) which extend in parallelism with the longitudinal direction (arrow 18) of the passage 19.

The means for removing particles 1 from the outlet 13 of the passage 19 and for advancing such particles in the direction of arrow 20 comprises a rotary drum-shaped carded conveyor 27 whose carding consists of needles or pins 26 extending from its peripheral surface and advancing along an endless path the apex of which is located directly below the outlet 13. A shroud 30 is placed next to the carding of the drum-shaped conveyor 27 to prevent premature escape of particles 1 from the spaces between the needles 26, namely before the particles advance into the range of a rapidly rotating picker roller 32 which is driven at a constant speed to rotate in a clockwise direction, as viewed in FIG. 1, and to expel the particles onto the upwardly sloping upper reach of a wide endless belt conveyor 33 serving to accumulate a continuous carpet or layer 35 of particulate material. The means for driving the conveyor 27 at a constant or variable speed comprises an electric motor 28, and the means for driving the picker roller 32 at a preferably constant speed comprises a further electric motor 31.

The conveyor 33 is trained over pulleys 34, 36 and is driven at a constant speed by an electric motor 37 which further drives a relatively wide endless belt conveyor 42 trained over pulleys 43, 44 and receiving lighter tobacco particles from a winnower 38. The latter is driven by the motor 31 for the picker roller 32. The purpose of the winnower 38 is to impart to the heavier tobacco particles 39*a* trajectories which are sufficiently different from the trajectories of lighter tobacco particles so that the heavier particles 39*a* can be gathered (in a container 41) and thus segregated from lighter particles which form a shower 39 and descend onto the upwardly sloping upper reach of the belt conveyor 42. The speed of the conveyor 42 preferably exceeds that of the conveyor 33. The upper reach of the conveyor 42 accumulates a wide and thin homogeneous layer or carpet of lighter tobacco particles, and the leader of such layer is delivered into the channel 46 wherein the lighter particles accumulate on the upper reach of the conveyor 47 to form the aforementioned narrow stream 49 which is ready for trimming (if necessary) and draping. The upper reach of the conveyor 47 preferably advances along the perforated top wall of a suction chamber which attracts the lighter particles to the conveyor 47 in an elongated stream growing zone at the station including the channel 46.

Figure 5:
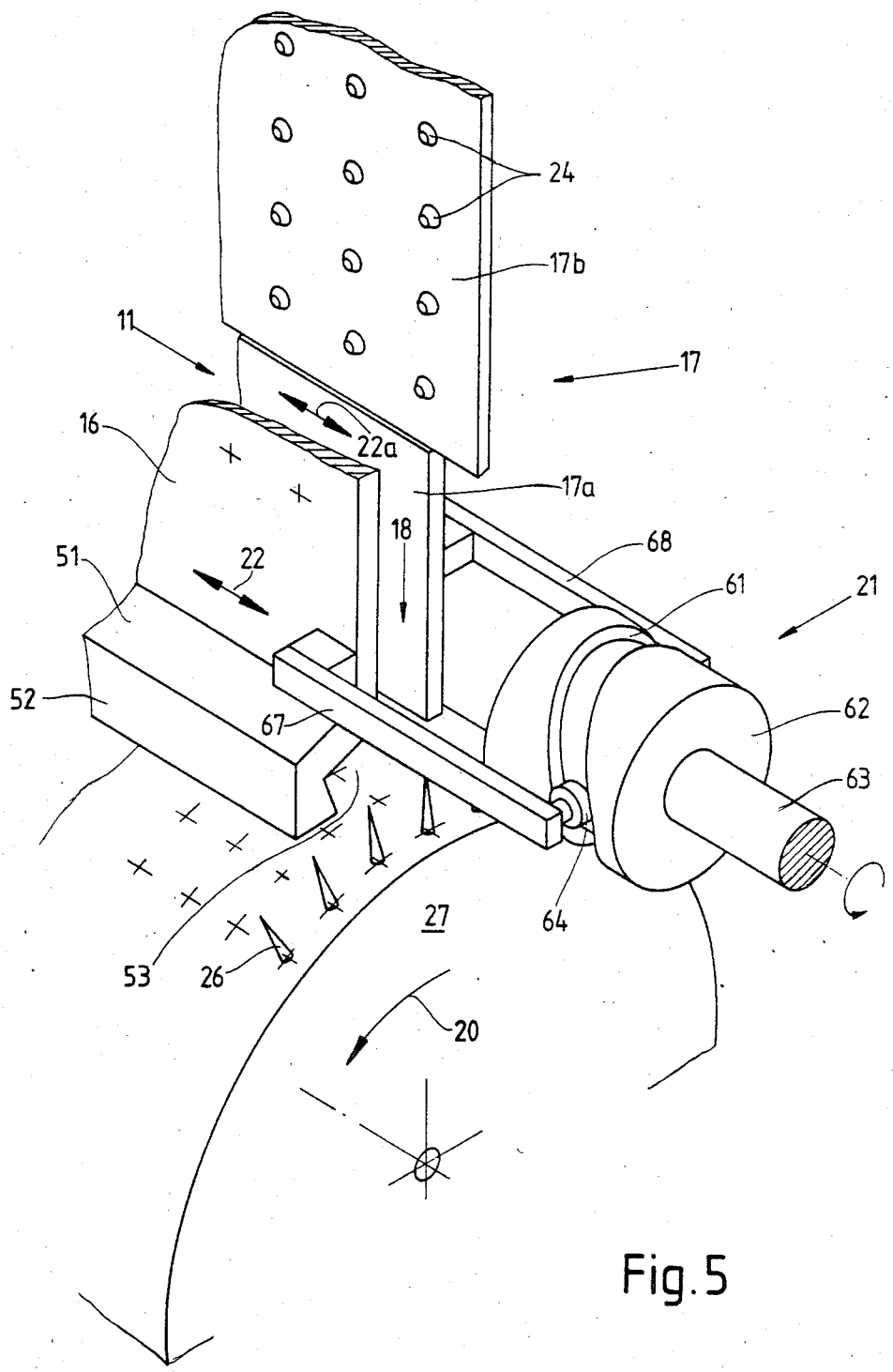
FIG. 5 is an enlarged fragmentary perspective view of the drive means for oscillating the downstream wall and the lower portion of the upstream wall, and a fragmentary perspective view of the removing conveyor.

The improved apparatus preferably further comprises a housing or cover 51 which is shown in FIGS. 1, 2 and 5 and is mounted on or forms an integral part of the lower portion of the downstream wall 16 of the duct 11. The housing 51 defines an elongated chamber 53 which extends at right angles to the plane of FIG. 1 or 2 and communicates with the downstream side of the outlet 13 so as to receive and confine the customarily developing roll of orbiting tobacco particles (indicated in FIG. 2 by the arrow 55) which, in the absence of the housing 51 and its chamber 53, would remain in the outlet 13 and could interfere with predictable transfer of particles 1 into the spaces between the needles 26 constituting the carding of the removing conveyor 27. The housing 51 includes an elongated downstream portion or barrier 52 which extends close to the path of the tips of needles 26 and prevents uncontrolled escape of particles 1 from the outlet 13 and chamber 53. Thus, the barrier 52 compels the particles which leave the chamber 53 and/or the outlet 13 to penetrate into the spaces between the needles 26; all other (surplus) particles are brushed off the tips of the needles 26 and remain in the chamber 53. The housing 51 exhibits the additional important advantage of maintaining a small supply of spare tobacco particles (in the chamber 53) which can penetrate into empty portions of the spaces between the needles 26 so as to ensure that the carding of the conveyor 27 advances a homogeneous mass of uniformly distributed particles which advance along the concave side of the shroud 30 and into the range of pins on the picker roller 32.

That side of the barrier 52 which faces the chamber 53 can be smooth or (and as shown in FIGS. 2 and 4) can be provided with shallow grooves or flutes 54 which extend in parallelism with the longitudinal direction (arrow 18) of the passage 19. The housing 51 shares the oscillatory movements of the wall 16.

The drive 21 (FIG. 5) for the wall 16 and the lower portion 17*a* of the wall 17 comprises a rotary input element 62 in the form of a cylindrical cam whose axis is parallel to the axis of the conveyor 27 and which has a suitably configurated endless cam groove 61 for two roller followers 64 (only one of these followers can be seen in FIG. 5). The followers 64 constitute component parts of two discrete output elements which further include elongated rod-like members or arms 67 and 68, respectively. The arm 67 is rigidly or articulately connected to the wall 16, and the arm 68 is rigidly or articulately connected to the lower portion 17*a* of the wall 17. As can be readily seen in FIG. 5, the roller followers 64 of the two output elements are disposed diametrically opposite each other with reference to the axis of the cam 62, and the configuration of the groove 61 in the periphery of the cam 62 is such that the oscillatory movements of the wall 16 are 180° out of phase with oscillatory movements of the lower portion 17*a* of the wall 17. The camshaft 63 which carries the cam 62 is driven by a further motor, not shown. FIG. 5 further shows that the directions (arrows 22 and 22*a*) of oscillatory movement of the wall 16 and lower portion 17*a* of the wall 17 are substantially or exactly parallel to the axis of the conveyor 27, i.e., such movements take place at right angles to the direction which is indicated by the arrow 18 and in the general planes of the respective walls 16, 17.

The particles 1 which are supplied by the pockets 3*a* of the conveyor 3 enter the inlet 12 and descend in the passage 19 of the duct 11 in the direction of arrow 18. The oscillating downstream wall 16 causes its protuberances 23 to move the adjacent particles 1 back and forth at right angles to the plane of FIG. 1 to thus ensure a highly uniform distribution of particles across the full width of the duct 11, as considered at right angles to the plane of FIG. 1 or 2. The stationary protuberances 24 at the inner side of the upper portion 17*b* of the upstream wall 17 cooperate with the oscillating protuberances 23 to ensure an even more uniform distribution of particles 1 across the entire larger transverse dimension of the passage 19. This, in turn, ensures that the outlet 13 invariably contains a highly homogenized supply of tobacco particles which enables the needles 26 to accumulate a homogeneous mass at the periphery of the removing conveyor 27. The accumulation of such homogeneous mass is further enhanced by the provision of the chamber 53 which receives the inevitable roll 55 of orbiting tobacco particles and thus enables the outlet 13 to deliver the lower end portion of the column of particles in the duct 11 into the range of oncoming needles 26 advancing beyond the lower end face of the oscillating lower end portion 17*a* of the wall 17.

The conveyors 33 and 42 thereupon form two successive layers or carpets 35, 40 and the winnower 38 ensures reliable segregation of undesirable heavier particles 39*a* from the lighter particles. This contributes to more satisfactory homogeneousness of the tobacco stream 49 on the conveyor 47 and to higher quality of the ultimate products.

The improved apparatus can be used in the distributors of mass producing cigarette makers as well as in the distributors of so-called laboratory machines which are used to make high-quality cigarettes for experimental purposes, e.g., prior to introduction of a new brand of cigarettes onto the market.

It is often sufficient to oscillate only a portion of at least one of the walls 16 and 17, e.g., the lower portion of the wall 16 or the lower portion 17*a* of the wall 17. The construction which is shown in the drawing has been found to be highly satisfactory because it ensures uniform distribution of tobacco particles which are supplied by the pockets 3*a* of the conveyor 3 before or not later than when such particles reach the outlet 13 so that the carding of the removing conveyor 27 invariably receives particles at a predictable rate for advancement into the range of the picker roller 32.

The housing 51 can be used with advantage in the improved apparatus as well as in conventional apparatus in order to provide room for reception of the aforediscussed roll 55 which tends to accumulate in the outlet of the passage irrespective of whether the walls of the duct are oscillated or not. The development of such roll is probably attributable to the sweeping action of the needles 26 which travel below the outlet 13 and change the direction of travel of adjacent particles 1 from that which is indicated by the arrow 18 to that which is indicated by the arrow 20. FIG. 2 shows that the dimensions of the chamber 53 need not appreciably exceed the dimensions of the roll 55. As mentioned above, the housing 51 performs the additional useful function of ensuring that the needles 26 can remove some particles from the chamber 53 if the spaces between such needles are not adequately filled with material which was removed from the outlet 13.

The provision of two conveyors (33, 42) and winnower 38 contributes to highly satisfactory further processing (including classification) of particles which are expelled from the carding of the conveyor 27 by the rapidly rotating picker roller 32. Such combination of elements 33, 38 and 42 can be used with advantage in the improved apparatus as well as in conventional distributors.

Figure 6:
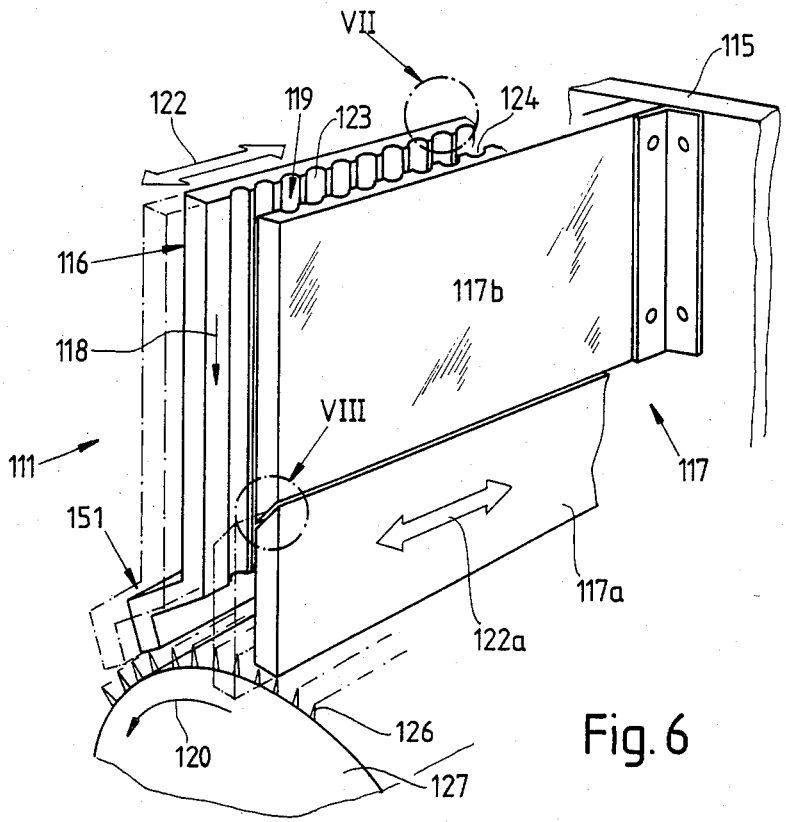
FIG. 6 is a fragmentary perspective view of a modified duct.

FIG. 6 shows a portion of a modified apparatus wherein all such parts which are identical with or clearly analogous to those shown in FIGS. 1 to 5 are denoted by similar reference characters plus 100. The duct 111 comprises an oscillatable (arrow 122) downstream wall 116, an upstream wall 117 which includes a stationary upper portion 117*b* and an oscillatable (arrow 122*a*) lower portion 117*a*, and two additional walls 115 (only one can be seen). At least the upper portion 117*b* of the wall 117 can be made of a light-transmitting material such as Plexiglas (trademark). The neighboring edge faces of portions 117*a*, 117*b* of the wall 117 make an oblique angle, e.g., an angle of approximately 120°.

The protuberances 23 of FIGS. 1, 2 and 4 are replaced by elongated parallel grooves or flutes 123 which are parallel to the direction indicated by the arrow 118 and extend all the way or at least substantially all the way between the upper and lower edge faces of the wall 116. The configuration of the surfaces bounding the grooves or flutes 123 can be readily seen in FIG. 7.

Figure 8:
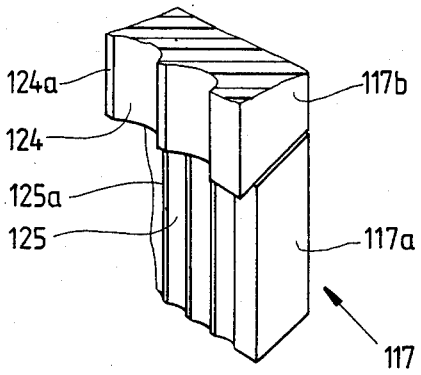
FIG. 8 is an enlarged view of a detail within the circle VIII of FIG. 6.

FIGS. 6 and 8 further show that the protuberances 24 on the upper portion 17*b* of the wall 17 are replaced with substantially vertically extending grooves or flutes 124 which are provided at the inner side of the stationary upper portion 117*b* of the wall 117. The inner side of the lower portion 117*a* of the wall 117 is provided with flutes or grooves 125 corresponding to the grooves 25 shown in FIGS. 2 and 3.

Figure 7:
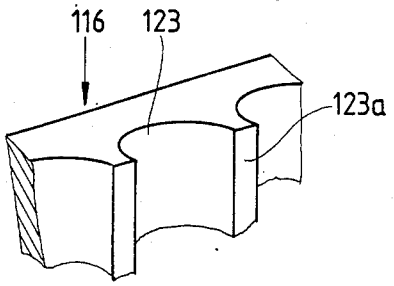
FIG. 7 is an enlarged view of a detail within the circle VII in FIG. 6.

It has been found that the apparatus which embodies the features of FIGS. 6 to 8 also ensures a highly satisfactory homogenization of fibrous material on its way from the inlet to the outlet of the passage which is defined by the duct 111. In fact, the homogenizing action is highly satisfactory even if the number of oscillations per minute is reduced to a fraction of those which are performed by the wall 16 and wall portion 17*a* of the apparatus shown in FIGS. 1–5. For example, the number of oscillations of the wall 16 and wall portion 17*a* can be in the range of 600 per minute, and the number of oscillations of the wall 116 and wall portion 117*a* can be in the range of 250 per minute.

The ribs 123*a*, 124*a*, 125*b* between the respective grooves 123, 124, 125 can be said to constitute elongated protuberances which extend into the passage 119.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for manipulating fibrous material, particularly for manipulating particles of tobacco in the distributor of a cigarette maker, comprising an at least substantially upright duct defining an elongated passage having an inlet at the upper end and an outlet at the lower end thereof, said duct comprising parallel first and second walls which are disposed opposite each other and flank said passage; means for supplying fibrous material into said inlet so that the material advances in said passage in a first direction toward said outlet; and drive means for imparting to one of said walls and to a portion of the other of said walls an oscillatory movement in a second direction substantially at right angles to said first direction and in the general planes of said walls to thus promote the distribution of fibrous material across said passage.

2. The apparatus of claim 1, further comprising means for removing fibrous material from the outlet of said passage and for advancing the removed material in a third direction at least substantially at right angles to at least one of said first and second directions, said one wall being located downstream of said other walls, as considered in said third direction.

3. The apparatus of claim 1, wherein said drive means includes means for oscillating at least a portion of each of said walls in said second direction.

4. The apparatus of claim 1, wherein said passage is at least substantially vertical.

5. The apparatus of claim 1, wherein said inlet has a rectangular cross-sectional outline with two longer sides defined by said walls and two shorter sides alternating with said longer sides, said duct further having third and fourth walls defining said shorter sides.

6. The apparatus of claim 1, further comprising conveyor means disposed at a level below said outlet and arranged to continuously remove fibrous material from said passage and to advance the removed material in a third direction at least substantially at right angles to at least one of said first and second directions.

7. The apparatus of claim 6, wherein said conveyor means comprises a rotary conveyor having a peripheral surface provided with carding for advancement of fibrous material from said outlet in said third direction.

8. The apparatus of claim 6, further comprising a housing defining with said duct a material-receiving chamber which communicates with and is disposed downstream of said outlet, as considered in said third direction.

9. The apparatus of claim 8, wherein said one wall is located downstream of said other wall, as considered in said third direction, and said housing is provided on said one wall.

10. The apparatus of claim 6, wherein said conveyor means comprises a rotary conveyor having a peripheral surface provided with carding for advancing fibrous material from said outlet in said third direction, and further comprising means for expelling the material from said carding and second conveyor means arranged to accumulate the expelled material in the form of a layer which advances in a predetermined direction.

11. The apparatus of claim 10, wherein said expelling means comprises a picker roller.

12. The apparatus of claim 10, further comprising means for driving said second conveyor means at a substantially constant speed.

13. The apparatus of claim 12, wherein said fibrous material contains lighter and heavier particles and further comprising winnower means arranged to receive successive increments of said layer from said second conveyor means and to propel the particles of such increments whereby the trajectories of lighter particles deviate from those of the heavier particles, means for driving said winnower means at a substantially constant speed, and third conveyor means for intercepting the propelled lighter particles.

14. The apparatus of claim 13, further comprising means for gathering the propelled heavier particles, means for driving said third conveyor means at a substantially constant speed, and means for converting the intercepted lighter particles into a stream.

15. Apparatus for manipulating fibrous material, particularly for manipulating particles of tobacco in the distributor of a cigarette maker, comprising an at least substantially upright duct defining an elongated passage having an inlet at the upper end and an outlet at the lower end thereof, said duct comprising first and second walls which are disposed opposite each other and flank said passage; means for supplying fibrous material into said inlet so that the material advances in said passage in a first direction toward said outlet; and drive means for imparting to at least a portion of at least one of said walls an oscillatory movement in a second direction substantially at right angles to said first direction and in the general plane of said one wall to thus promote the distribution of fibrous material across said passage, said one wall having a plurality of material-engaging and agitating protuberances extending into said passage.

16. Apparatus for manipulating fibrous material, particularly for manipulating particles of tobacco in the distributor of a cigarette maker, comprising an at least substantially upright duct defining an elongated passage having an inlet at the upper end and an outlet at the lower end thereof, said duct comprising first and second walls which are disposed opposite each other and flank said passage; means for supplying fibrous material into said inlet so that the material advances in said passage in a first direction toward said outlet; drive means for imparting to at least a portion of at least one of said walls an oscillatory movement in a second direction substantially at right angles to said first direction and in the general plane of said one wall to thus promote the distribution of fibrous material across said passage; and means for removing fibrous material from the outlet of said passage and for advancing the removed material in a third direction at least substantially at right angles to at least one of said first and second directions, said one wall being located downstream of the other of said walls, as considered in said third direction, and having a plurality of material-engaging and agitating protuberances extending into said passage.

17. The apparatus of claim 15, wherein said protuberances are arrayed in first rows extending in said first direction and second rows extending in said second direction, the mutual spacing of neighboring protuberances in said first rows being at least substantially identical with the mutual spacing of neighboring protuberances in said second rows.

18. Apparatus for manipulating fibrous material, particularly for manipulating particles of tobacco in the distributor of a cigarette maker, comprising an at least substantially upright duct defining an elongated passage having an inlet at the upper end and an outlet at the lower end thereof, said duct comprising first and second walls which are disposed opposite each other and flank said passage; means for supplying fibrous material into said inlet so that the material advances in said passage in a first direction toward said outlet; and drive means for imparting to at least a portion of each of said walls an oscillatory movement in a second direction substantially at right angles to said first direction and in the general planes of the respective walls so as to promote the distribution of fibrous material across said passage, said drive means including means for oscillating said portion of one of said walls out of phase with oscillation of said portion of the other of said walls.

19. The apparatus of claim 18, further comprising means for removing fibrous material from the outlet of said passage and for advancing the removed material in a third direction at least substantially at right angles to at least one of said first and second directions, said one wall being located downstream of said other wall, as considered in said third direction, and said portion of said other wall being adjacent to the outlet of said passage.

20. The apparatus of claim 19, wherein said portion of said other wall has a smooth side facing said outlet.

21. The apparatus of claim 19, wherein said portion of said other wall has a side facing said outlet and provided with shallow grooves.

22. The apparatus of claim 21, wherein said grooves extend in said first direction.

23. The apparatus of claim 19, wherein said other wall has a second portion at a level above said outlet, said second portion having stationary protuberances extending into said passage.

24. The apparatus of claim 23, wherein said one wall has additional protuberances extending into said passage opposite said stationary protuberances, said additional protuberances being oscillatable by said drive means and said stationary protuberances being disposed at a plurality of first levels, said additional protuberances being disposed at a plurality of second levels at least some of which alternate with at least some of said first levels.

25. The apparatus of claim 24, wherein at least some of said additional protuberances are oscillatable by said drive means with reference to discrete stationary protuberances between first and second end positions at the opposite sides of the corresponding stationary protuberances, as considered in said second direction.

26. Apparatus for manipulating fibrous material, particularly for manipulating particles of tobacco in the distributor of a cigarette maker, comprising an at least substantially upright duct defining an elongated passage having an inlet at the upper end and an outlet at the lower end thereof, said duct comprising first and second walls which are disposed opposite each other and flank said passage; means for supplying fibrous material into said inlet so that the material advances in said passage in a first direction toward said outlet; and drive means for imparting to at least a portion of each of said walls an oscillatory movement in a second direction substantially at right angles to said first direction and in the general plane of the respective wall to thus promote the distribution of fibrous material across said passage, said drive means comprising a single input element and first and second output elements receiving oscillatory motion from said input element and arranged to transmit motion to said portion of said first and second wall, respectively.

27. Apparatus for manipulating fibrous material, particularly for manipulating particles of tobacco in the distributor of a cigarette maker, comprising an at least substantially upright duct defining an elongated passage having an inlet at the upper end and an outlet at the lower end thereof, said duct comprising first and second walls which are disposed opposite each other and flank said passage; means for supplying fibrous material into said inlet so that the material advances in said passage in a first direction toward said outlet; drive means for imparting to at least a portion of at least one of said walls an oscillatory movement in a second direction substantially at right angles to said first direction and in the general plane of said one wall to thus promote the distribution of fibrous material across said passage; conveyor means disposed at a level below said outlet and arranged to continuously remove fibrous material from said passage and to advance the removed material in a third direction at least substantially at right angles to at least one of said first and second directions, said one wall being located downstream of the other of said walls, as considered in said third direction; and a housing provided on said one wall and defining with said duct a material-receiving chamber which communicates with and is disposed downstream of said outlet, as considered in said third direction, said housing including a barrier disposed downstream of said one wall and at a level above said conveyor means.

28. The apparatus of claim 27, wherein said barrier has a smooth side facing said chamber.

29. The apparatus of claim 27, wherein said barrier has a side facing said chamber and provided with shallow grooves.

30. The apparatus of claim 29, wherein said grooves extend in said first direction.

31. Apparatus for manipulating fibrous material, particularly for manipulating particles of tobacco in the distrubutor of a cigarette maker, comprising an at least substantially upright duct defining an elongated passage having an inlet at the upper end and an outlet at the lower end thereof, said duct comprising first and second walls which are disposed opposite each other and flank said passage; means for supplying fibrous material into said inlet so that the material advances in said passage in a first direction toward said outlet; and drive means for imparting to at least a portion of at least one of said walls an oscillatory movement in a second direction substantially at right angles to said first direction and in the general plane of said one wall to thus promote the distribution of fibrous material across said passage, said one wall having a side facing said passage and a plurality of elongated grooves provided in said side and extending in said first direction.

32. The apparatus of claim 31, wherein the other of said walls has a side facing said passage and a plurality of elongated grooves provided in said side of said other wall and extending in said first direction.

33. The apparatus of claim 32, wherein said other wall includes a first portion adjacent to said outlet and a stationary second portion disposed at a level above said outlet, said drive means being arranged to oscillate said one wall and said first portion of said other wall.

34. The apparatus of claim 33, wherein the grooves in said side of said one wall extend all the way from said inlet to said outlet.

35. The apparatus of claim 33, wherein the grooves of said other wall include a first set of parallel grooves provided in said second portion and extending all the way from said inlet to said first portion and a second set of grooves extending from said second portion all the way to said outlet.

36. The apparatus of claim 32, wherein the grooves in said side of said other wall are at least substantially identical with the grooves in said side of said one wall.

37. Apparatus for manipulating fibrous material, particularly for manipulating particles of tobacco in the distributor of a cigarette maker, comprising a duct having an inlet and an outlet; means for admitting fibrous material into said inlet; and means for removing fibrous material from said outlet and for advancing the removed material in a predetermined direction, said duct having a material-receiving chamber which communicates with and is disposed downstream of said outlet, as considered in said direction, said duct including a barrier disposed downstream of said chamber and having a side facing said chamber and provided with shallow grooves.

* * * * *

UNITED STATES PATENT AND TRADEMARK OFFICE

CERTIFICATE OF CORRECTION

PATENT NO. : 4,681,124

DATED : July 21, 1987

INVENTOR(S) : Alfred HINZMANN et al.

It is certified that error appears in the above-identified patent and that said Letters Patent are hereby corrected as shown below:

Foremost Page [75] Inventors: after "Richmond" change "," to --;-- and insert --Timor Shu, Richmond,--.

Signed and Sealed this

Twenty-second Day of December, 1987

*Attest:*

DONALD J. QUIGG

*Attesting Officer*

*Commissioner of Patents and Trademarks*